US008464670B2

(12) United States Patent
Hofbauer et al.

(10) Patent No.: US 8,464,670 B2
(45) Date of Patent: Jun. 18, 2013

(54) GUIDED BRIDGE FOR A PISTON IN AN INTERNAL COMBUSTION ENGINE

(75) Inventors: Peter Hofbauer, West Bloomfield, MI (US); Adrian N. Tusinean, Windsor (CA); Chou Lee, Warren, MI (US)

(73) Assignee: EcoMotors International, Allen Park, MI (US)

( * ) Notice: Subject to any disclaimer, the term of this patent is extended or adjusted under 35 U.S.C. 154(b) by 402 days.

(21) Appl. No.: 12/723,418

(22) Filed: Mar. 12, 2010

(65) Prior Publication Data

US 2010/0229836 A1 Sep. 16, 2010

Related U.S. Application Data

(60) Provisional application No. 61/209,904, filed on Mar. 12, 2009.

(51) Int. Cl.
*F02B 25/08* (2006.01)

(52) U.S. Cl.
USPC ..... 123/51 R; 123/51 A; 123/51 B; 123/54.1

(58) Field of Classification Search
USPC ..... 123/51 R, 51 A, 51 B, 51 BB, 51 BD, 123/54.1, 54.4–55.7
See application file for complete search history.

(56) References Cited

U.S. PATENT DOCUMENTS

| | | | | |
|---|---|---|---|---|
| 2,548,686 | A * | 4/1951 | Sherman | 74/60 |
| 5,829,393 | A * | 11/1998 | Achten et al. | 123/46 A |
| 6,170,443 | B1 | 1/2001 | Hofbauer | |
| 6,948,459 | B1 * | 9/2005 | Laumen et al. | 123/46 R |
| 6,953,010 | B1 * | 10/2005 | Hofbauer | 123/46 R |
| 7,434,550 | B2 | 10/2008 | Hofbauer | |
| 2003/0098000 | A1 * | 5/2003 | Vorih et al. | 123/90.12 |
| 2005/0284426 | A1 * | 12/2005 | Tusinean | 123/46 R |
| 2005/0284428 | A1 * | 12/2005 | Tusinean et al. | 123/46 SC |
| 2006/0042575 | A1 * | 3/2006 | Schmuecker et al. | 123/46 R |
| 2009/0314232 | A1 * | 12/2009 | Howell-Smith | 123/55.2 |

* cited by examiner

*Primary Examiner* — Noah Kamen
*Assistant Examiner* — Long T Tran
(74) *Attorney, Agent, or Firm* — Diana D. Brehob

(57) ABSTRACT

An improved configuration for internal combustion engine that reduces side forces on pistons during the engine cycle. The improvement is an intermediate and guided bridge element located between pull rods and pistons with articulated connections that allow side forces to be dissipated away from the pistons.

22 Claims, 7 Drawing Sheets

GUIDED BRIDGE FOR A PISTON IN AN INTERNAL COMBUSTION ENGINE

RELATED APPLICATIONS

This application claims priority benefit of provisional application Ser. No. 61/209,904, filed Mar. 12, 2009.

TECHNICAL FIELD

This invention is related to the field of internal combustion engines and more specifically to improvements in such engines configured with opposing cylinders and opposing pistons in each cylinder ("OPOC engine").

BACKGROUND

This invention involves improvements to internal combustion engines and in particular OPOC engines of the type described and claimed in earlier U.S. Pat. Nos. 6,170,443, and 7,434,550, which are incorporated herein by reference. Other types of OPOC engines having one or more crankshafts, also can benefit from the present invention.

As background, the OPOC engine from U.S. Pat. No. 6,170,443 is shown in FIGS. 1 and 2. In those figures, the engine configuration is shown to comprise a left cylinder 100 (1100 FIG. 2), a right cylinder 200 (1200), and a single central crankshaft 300 (1300) located between the cylinders. The left cylinder 100 has an outer piston 110 and an inner piston 120, with combustion faces 111 and 121 respectively, the two pistons forming a combustion chamber 150 between them. The right cylinder 200 similarly has an outer piston 210, an inner piston 220, with combustion faces 211 and 221 and combustion chamber 250. Each of the four pistons 110, 120, 210, and 220 are connected to a separate eccentric on the crankshaft 300 (1300).

The inner piston 120 of the left cylinder 100 is connected to crankshaft eccentric 312 by means of pushrod 412; the inner piston 220 of the right cylinder 200 is similarly connected to crankshaft eccentric 322 by pushrod 422. During normal engine operation, pushrods 412 and 422 are always under compression. The pushrods have concave ends 413 and 423 which ride on convex cylindrical surfaces 125 and 225 on the rear of the inner pistons.

The outer piston 110 of the left cylinder 100 (1100) is connected to crankshaft eccentric 311 by means of pullrod 411 (1411); the outer piston 210 of the right cylinder 200 (1200) is similarly connected to crankshaft eccentric 321 by pullrod 421 (1421). During normal engine operation, pullrods 411 (1411) and 421 (1421) are always under tension. While single pullrods are shown on the near side in FIGS. 1 and 2, it should be understood that pairs of pullrods are used, with one pullrod on the near side of each cylinder and one on the far side of each cylinder. The near and far side pullrods connect to separate crankshaft journals having the same angular and offset geometries. The pullrods 411 (1411) and 421 (1421) communicate with the outer pistons by means of pins 114 (1114) and 214 (1214) that pass through slots (1115) and (1215) in the cylinder walls The four pistons 110, 120, 210, and 220 have a plurality of piston rings 112, 122, 212, and 222, respectively, located behind the combustion faces. Additional piston rings may be added to the piston skirts, as may be required to reduce wear and control lubrication oil distribution. The cylinders 100 and 200 each have intake, exhaust, and fuel injection ports. On the left cylinder 100, the outer piston 110 opens and closes intake ports 161 (intake piston) and the inner piston 120 opens and closes exhaust ports 163 (exhaust piston). Fuel injection port 162 is located near the center of the cylinder. On the right cylinder 200, the inner piston 220 opens and closes intake ports 261 and the outer piston opens and closes exhaust ports 263. Again, fuel injection port 262 is located near the center of the cylinder. The asymmetric arrangement of the exhaust and intake ports on the two cylinders serves to help dynamically balance the engine, as described below.

Each of the four crankshaft eccentrics 311, 312, 321, and 322 are positioned with respect to the crankshaft rotational axis 310. The eccentrics for the inner pistons 312, 322 are further from the crankshaft rotational axis than the eccentrics for the outer pistons 311, 321, resulting in greater travel for the inner pistons than for the outer pistons. The eccentrics for the inner left piston 312 and the outer right piston 321, the pistons which open and close the exhaust ports in the two cylinders, are angularly advanced, while the eccentrics for the outer left piston 311 and inner right piston 322 are angularly retarded (note that the direction of crankshaft rotation is counterclockwise, as indicated by the arrow in FIG. 1).

As further shown in FIGS. 1 and 2, each cylinder is supercharged. Supercharging improves scavenging, improves engine performance at low rpms and recovers energy from the engine exhaust.

As mentioned above, the pullrods are always under tension forces $F_r$ that are communicated to and from the piston (via piston pins) as compression forces $F_p$. During the times that the pullrods are at an angle with respect to the reciprocating axis of the outer pistons, there are minor side force components $F_s$ generated at the outer piston pins 114 (1114) and 214 (1214). These side forces occur during both the power and compression strokes of the engine cycle and are directed towards the cylinder walls. Several efforts have been made to minimize the effects of such side forces, including increasing the lubrication between the cylinder wall and the piston skirt; providing more piston rings along the piston skirt; and reducing the length of the piston skirt. However, each conventional attempt to reduce the effects of pullrod side forces has resulted in other undesirable effects.

SUMMARY OF THE INVENTION

The present invention provides reduction in the side forces attributed to pullrod connections to the outer pistons of an OPOC engine by providing an intermediate bridge member between the pullrods and the outer piston to dissipate the side forces and isolate them from reaching the outer piston.

The present invention provides reduction in the side forces attributed to pullrod connections to the outer pistons of an OPOC engine by providing an intermediate bridge member with articulated low friction connections to the pullrods and the outer piston.

The present invention provides reduction in the side forces attributed to pullrod connections to the outer pistons of the OPOC engine by providing an extension to the cylinder housing with a pair of elongated side openings with lubricated guide edge bearing surfaces for allowing an intermediate bridge member between the pullrods and the outer pistons to slide there-along during engine operation to dissipate the side forces and isolate them from reaching the outer piston.

The present invention provides reduction in the side forces attributed to pullrod connections to the outer pistons of the OPOC engine by providing a low friction and rotatable bearing connection between the pullrods and the intermediate bridge member that is located between the pullrods and the outer piston.

The present invention provides reduction in the side forces attributed to pullrod connections to the outer pistons of the OPOC engine by providing a ball joint connection between the intermediate bridge member and the outer piston.

Two embodiments of the intermediate bridge element are shown. In a first embodiment, the bridge element contains a pair of upper and lower wear pads that contact the lubricated guide edge bearing surfaces provided by the extension to the cylinder housing. In a second embodiment, the upper and lower surfaces of the intermediate bridge element are used to directly contact and slide along the lubricated guide edge bearing surfaces provided by the extension to the cylinder housing.

It is an object of the present invention to provide an improved OPOC engine with reduced friction and increased efficiencies by eliminating side forces on the outer pistons during the engine cycle.

It is another object of the present invention to provide an improved OPOC engine in which the connections between the outer pistons and their associated pull rods do not allow the communication of off-axis side forces to either element.

DETAILED DESCRIPTION OF THE INVENTION

Figure 1:
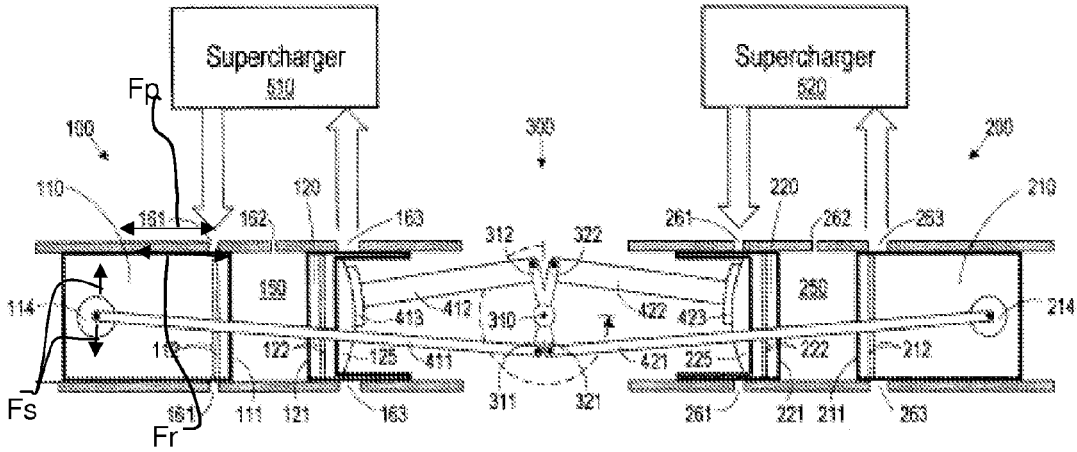
Fig. 1 (Prior Art)
FIG. 1 is a cross-sectional concept view depicting the operative elements of a prior art OPOC engine configuration and is discussed above.
Figure 2:
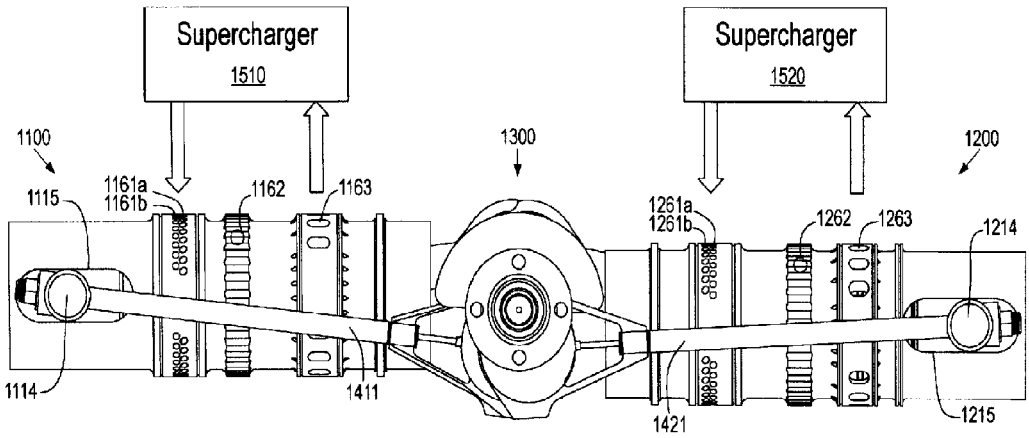
Fig. 2 (Prior Art)
FIG. 2 is a plan view of a physical embodiment of the same prior art OPOC engine shown in FIG. 1.
Figure 3:
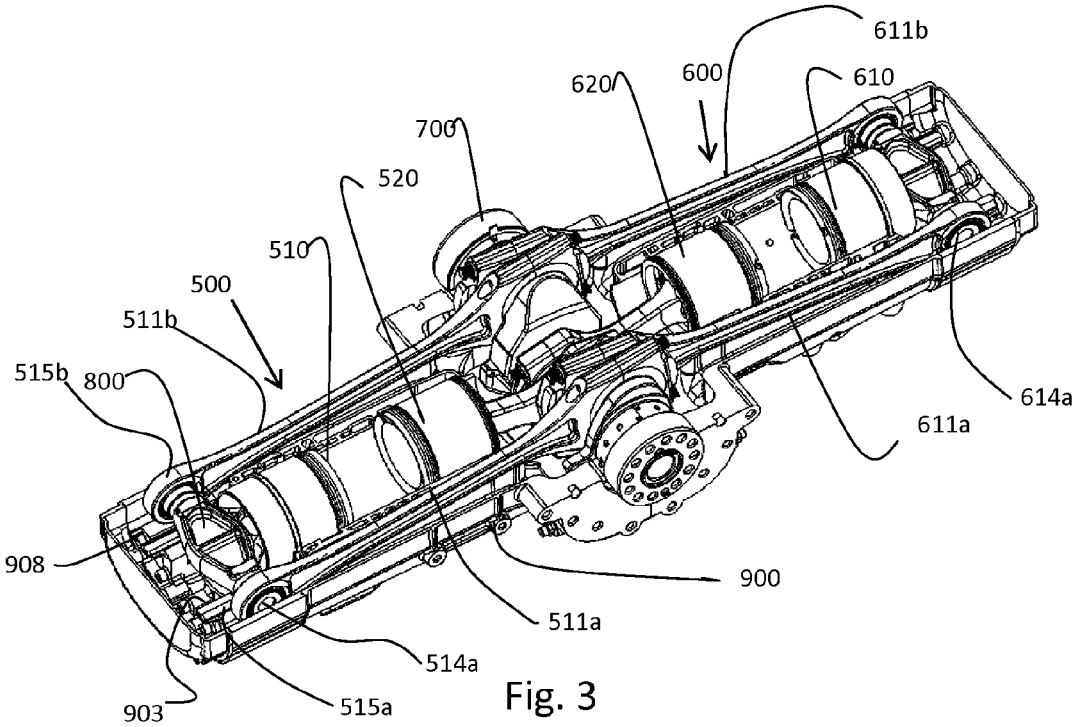
FIG. 3 and FIG. 7 are cut-away perspective views of an OPOC engine and a portion of an OPOC engine, respectively, containing-embodiments of the present disclosure.
Figure 4:
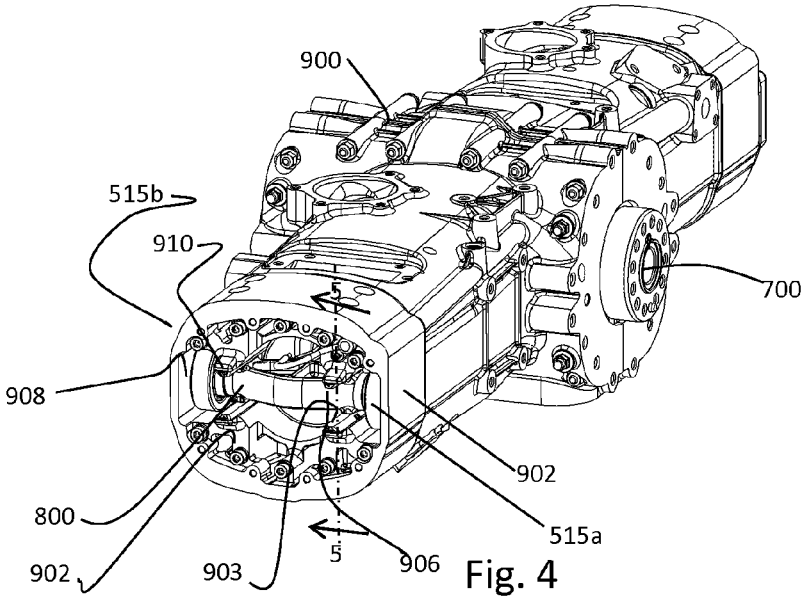
FIG. 4 is a perspective view of the OPOC engine shown in FIG. 3 with one end cut-away to illustrate the present invention.
Figure 6:
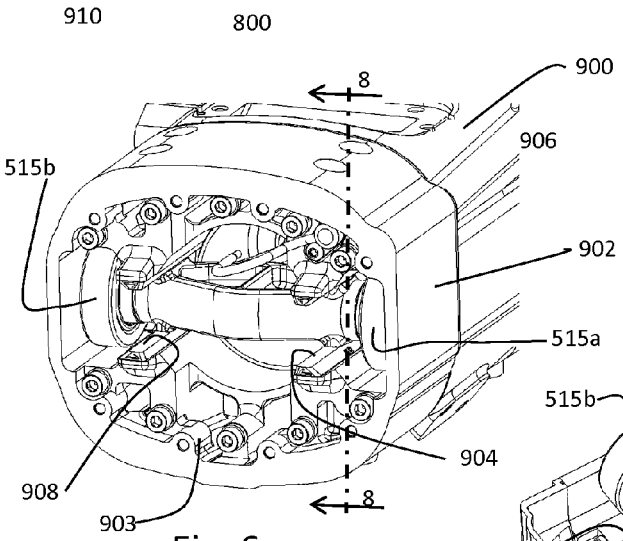
FIG. 6 is an enlarged view of a portion of the OPOC engine shown in FIG. 4, containing an embodiment of the present invention.
Figure 7:
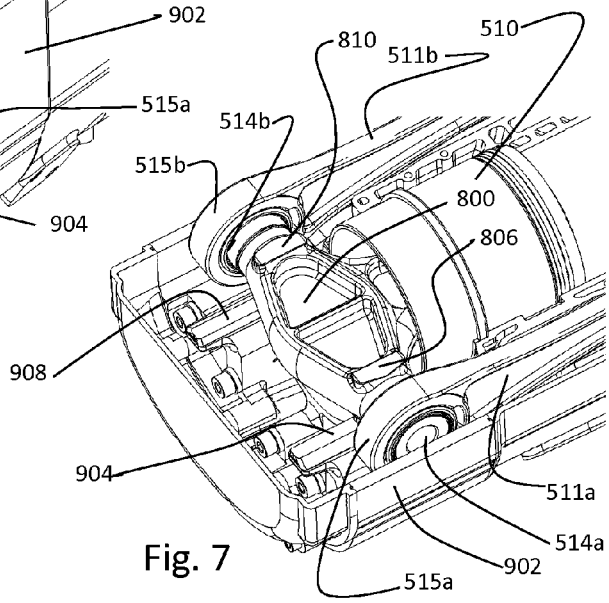
Figure 5:
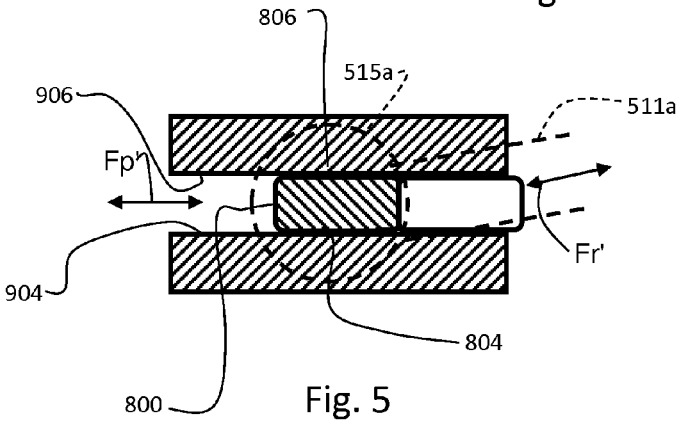
FIG. 5 is a cross-sectional illustration of an embodiment of the present invention taken along lines 5-5 in FIG. 4.
Figure 8:
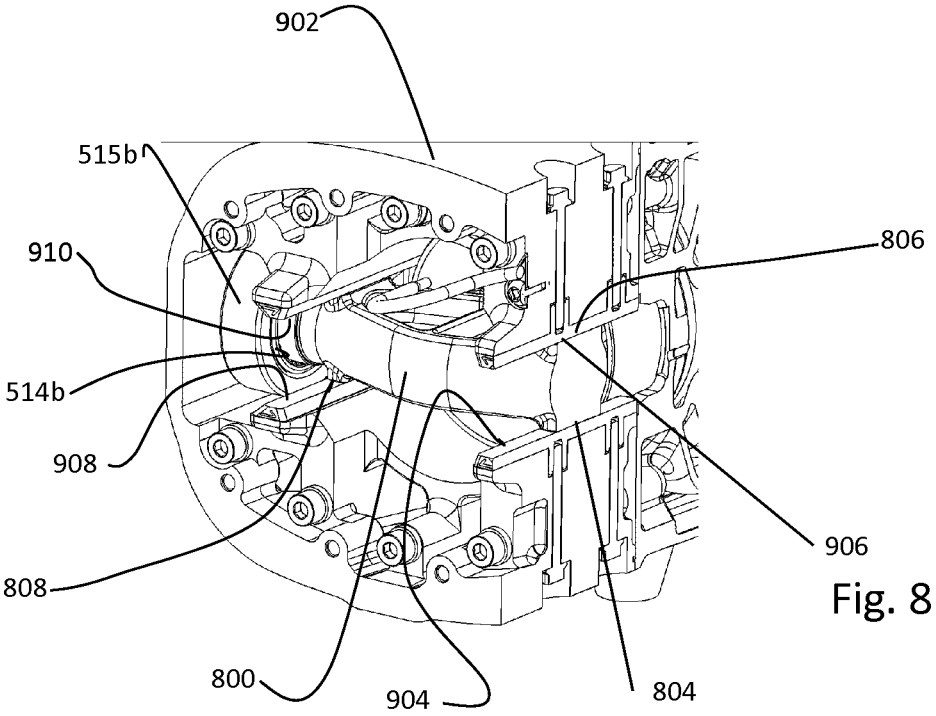
FIG. 8 is a partial cross-sectional view taken along section line 8-8 in FIG. 6.
Figure 9:
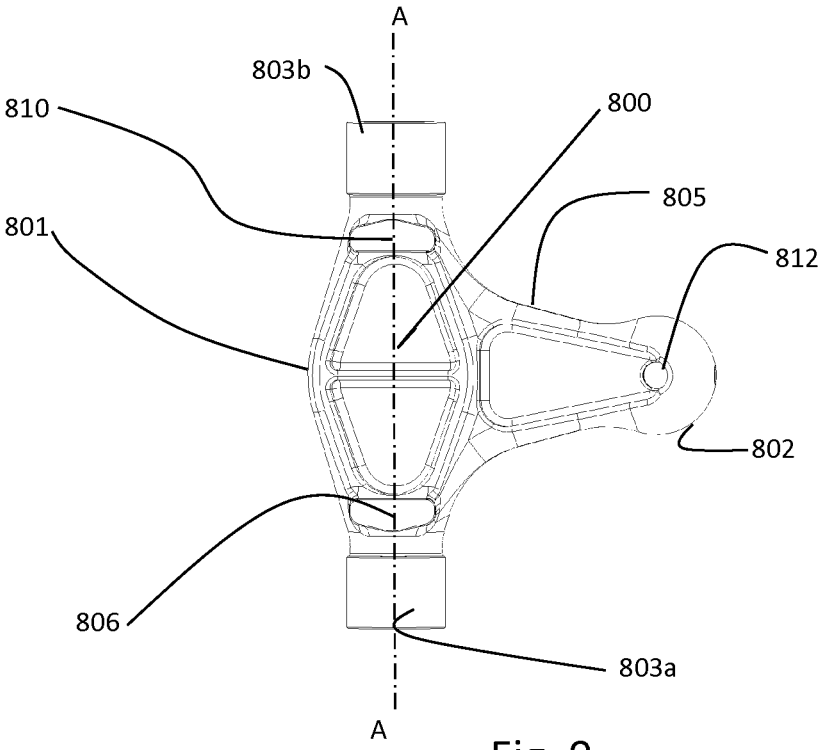
FIG. 9 is an enlarged top plan view of the pull rod bridge element of the present invention.
Figure 10:
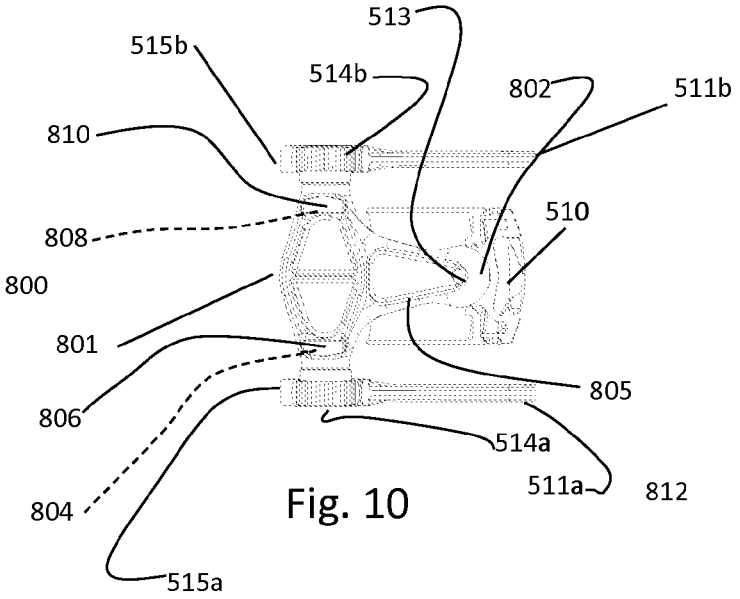
FIG. 10 is a top plan view of an embodiment of the guided bridge connected between pull rods and the outer piston of an OPOC engine.
Figure 11:
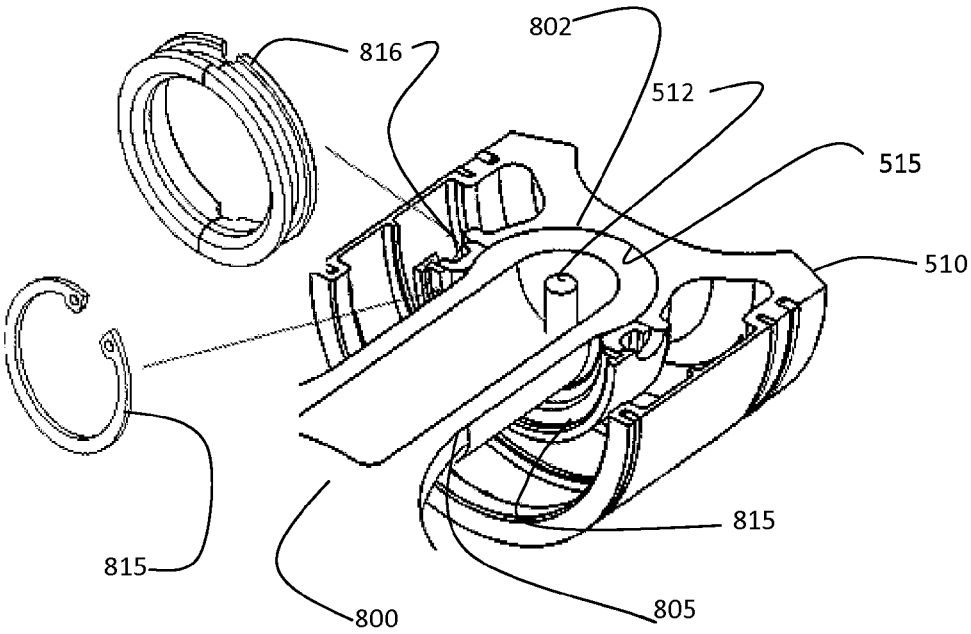
FIG. 11 is a perspective view of the underside of a first embodiment of an OPOC engine outer piston configured to mate with the guided bridge shown in FIGS. 9 and 10.

The present invention is shown in FIGS. 3-13, in conjunction with an OPOC engine of the type described above and incorporated herein by reference. In FIG. 3, an OPOC engine is shown as having a left cylinder 500, a right cylinder 600 in a housing 900 and a common crankshaft 700. Left cylinder 500 has an outer piston 510 and an inner piston 520. Opposing right cylinder 600 has an outer piston 610 and an inner piston 620. Outer piston 510 is connected to crankshaft 700 via a pair of pull rods 511*a* and 511*b*. Outer piston 610 is connected to the crankshaft 700 via a pair of pull rods 611*a* and 611*b*.

The improvement over the prior art OPOC engine described above results from the use of a guided bridge 800 that is located between the outer piston 510 and the pullrods 511*a* and 511*b*. (Although the following discussion is directed to the left cylinder 500, it should be understood that the right cylinder is identically configured to provide identical improvements to the engine as a whole.)

Guided bridge 800 is mounted for reciprocating movement in an extension cap 902 that connects to and forms part of engine housing 900. Guided bridge 800, in this embodiment, (see FIGS. 9 and 10) has a generally triangular shape with its base 801 being connected to the parallel pullrods 515*a* and 515*b*, and the a ball shaped nose 802 extending from the apex of the triangular shape along a projection 805. Bridge nose 802 is formed as a spherical ball for mating with a like hemispherical ball socket 512 in outer piston 510. The spherical mating of the bridge to the piston provides for point contact between those elements which in turn provides increased flexibility between the two to significantly reduce side forces being imposed onto the piston.

Guided bridge 800 is mounted for reciprocating movement in an extension cap 902 that connects to and form a part of engine housing 900. Guided bridge 800, in this embodiment, (see FIGS. 9 and 10) has a generally triangular shape with its base 801 being connected to the parallel pullrods 511*a* and 511*b* and the a ball shaped nose 802 extending from the apex of the triangular shape along a projection 805. Bridge nose 802 is formed as a spherical ball for mating with a like hemispherical ball socket 512 in outer piston 510. The spherical mating of the bridge to the piston provides for point contact between those elements which in turn provides increased flexibility between the two to significantly reduce side forces being imposed on to the piston.

The base 801 of the triangular shaped guided bridge 800 has bosses 803*a* and 803*b* that extend outwardly along a horizontal axis "A-A" that is perpendicular to the cylinder axis. Bosses 803*a* and 803*b* fit within the races of needle bearings 514*a* and 514*b* (FIG. 13) that are mounted in hubs 515*a* and 515*b* of pullrods 511*a* and 511*b*, respectively. The upper and lower surfaces 804/806 and 808/810 of the guided bridge 800 are ground smooth and serve as the contact points with respect to the lower and upper guide surfaces 904/906 and 908/910 formed in extension cap 902.

While the embodiment above is described as having guided bridge face surfaces to guide face surfaces as being smoothly ground or polished metal surfaces, it is because such surfaces can be formed very economically with significantly improved results compared to the prior art. However, it is appreciated that other low friction alloy, ceramic or plastic materials could be implanted into the opposing surfaces to have sliding surface contact if their low friction properties are suitable for improvements in this environment.

Outer piston 510 (FIGS. 10 and 11) is configured with a hemispherical ball socket 513 to receive the forward part of spherical bridge nose 802 and provide for a spherical contact between guided bridge 800 and outer piston 510. An expandable wear ring 816 and a snap ring are held in separate circular channels within the under cavity of piston 510 and surround projection 805, below bridge nose 802. Expandable wear ring 816 along with snap ring 815 function to keep the spherical socket 512 and bridge nose 802 connected during assembly and during the crank start prior to engine operation. Constant compression during engine operation serves to maintain the connection and no pressure is exerted on those elements during the operation. During the crank start period and prior to ignition, there are periods when the pull rods 511*a* and 511*b* draw the outer piston 510 outwards towards its bottom dead center position. That is when it is necessary for the piston 510 to be retained in contact with the bridge nose 802 on the guided bridge 800.

Outer piston 510 (FIGS. 10 and 11) is configured with a hemispherical ball socket 515 to receive the forward part of spherical bridge nose 802 and provide for spherical contact between guided bridge 800 and outer piston 510. An expandable wear ring 816 and a snap ring are held in separate circular channels within the under cavity of piston 510 and surround projection 805, below bridge nose 802. Expandable wear ring 816 along with snap ring 815 function to keep the spherical socket 515 and bridge nose 802 connected during assembly and during the crank start prior to engine operation. Constant compression during engine operation serves to maintain the connection and no pressure is exerted on those elements during the operation. During the crank start period and prior to ignition, there are periods when the pull rods 511*a* and 511*b* draw the outer piston 510 outwards towards its bottom dead center position. That is when it is necessary for the piston 510 to be retained in contact with the bridge nose 802 on the guided bridge 800.

When the pistons of left cylinder 500 enter their power stoke of the engine cycle, the expanding gases present on the face of piston 510 force the ball socket 512 against the bridge nose 802. Due to the interaction of the bosses 803*a* and 803*b* with the bearings 514*a* and 514*b*, and the resistance of the angled pull rods 511*a* and 511*b*, any side forces that are generated are directed between upper and lower surfaces 804/806 and 808/810 of guided bridge 800 to the corresponding lower and upper guide surfaces 904/906 and 908/910 while guided bridge 800 is sliding there along. As a result, almost all pullrod generated side forces are dissipated so as not to be fed back and effect the travel of outer piston 510.

When the pistons of left cylinder 500 enter their compression stoke of the engine cycle, pull rods 511*a* and 511*b* are again under tension and being pulled by the crank shaft 700. Pull rods 511*a* and 511*b* interact with guided bridge 800 through bearings 514*a* and 514*b* and bosses 803*a* and 803*b* to force the bridge nose 802 against socket 512. This action causes outer piston 510 to be pushed along the cylinder axis towards inner piston 520 against the resistance of air being compressed within the cylinder. Due to the interaction of the angled pull rods 511*a* and 511*b* through bearings 514*a* and 514*b* with bosses 803*a* and 803*b* and the resistance of outer piston 510, any side forces that are generated are directed between the upper and lower surfaces 804/806 and 808/810 of the guided bridge 800 to the corresponding lower and upper guide surfaces 904/906 and 908/910 while guided bridge 800 is sliding there along. Consequently almost all pullrod generated side forces are isolated from outer piston 510. As stated earlier, the reduction in side forces on the pistons of an internal combustion engine is highly desirable in order to reduce piston chafing or scuffing that may sometimes occur during operating conditions.

Figure 12:
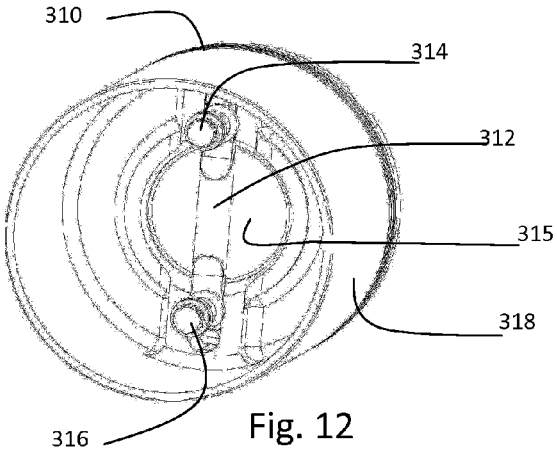
FIG. 12 is a perspective view of the underside of a second embodiment of an OPOC engine outer piston configured to mate with the guided bridge shown in FIGS. 9 and 10.
Figure 13:
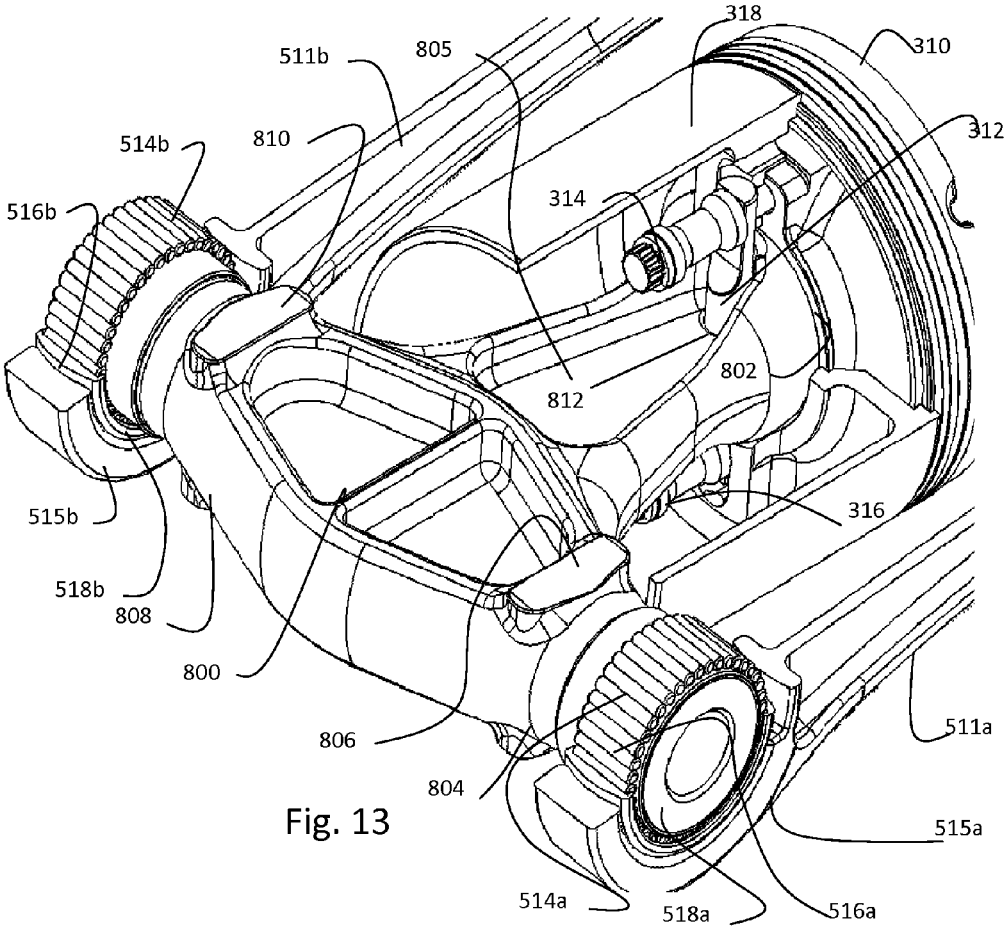
FIG. 13 is a perspective partial cross-sectional view of a bridge assembly the present embodiment mated with a second embodiment of the outer piston shown in FIG. 12.

FIGS. 12 and 13 illustrate another piston configuration 310 in which a spherical socket 315 mates with bridge nose 802 on guided bridge 800. This piston differs from the earlier described piston 510 in the manner in which it is retained to guided bridge 800, In this case, a pin 312 is fastened to the underside of piston 310 by bolts 314 and 316 (or by other equivalent retaining devices). Pin 312 is fitted through vertical hole 812 in bridge nose 802 and held in place by bolts 314 and 316. Piston 310 provides for alternative connection means and may offer improvements in durability or assembly costs.

FIG. 13 also illustrates an improved bearing structure that may be employed in the present invention to further reduce undesired forces to the elements. In this case, the use of a spherical bearing race ring 518*a* and 518*b* inside pull rod hubs 515*a* and 515*b* provides added rotational flexibility. The circular inner surfaces of pull rod hubs 515*a* and 515*b* are spherically curved to accept race rings 518*a* and 518*b* having like outer circular surfaces that are also spherically curved. The mating spherical surfaces provide a spherical bearing that allows for minor rotation to occur between the bosses of guide 800 and the pull rods without creating bending torque on the pull rods. The inner surface of race rings 518*a* and 518*b* are planar to support the rotation of needle bearings 514*a* and 514*b* in a conventional fashion.

Figure 14:
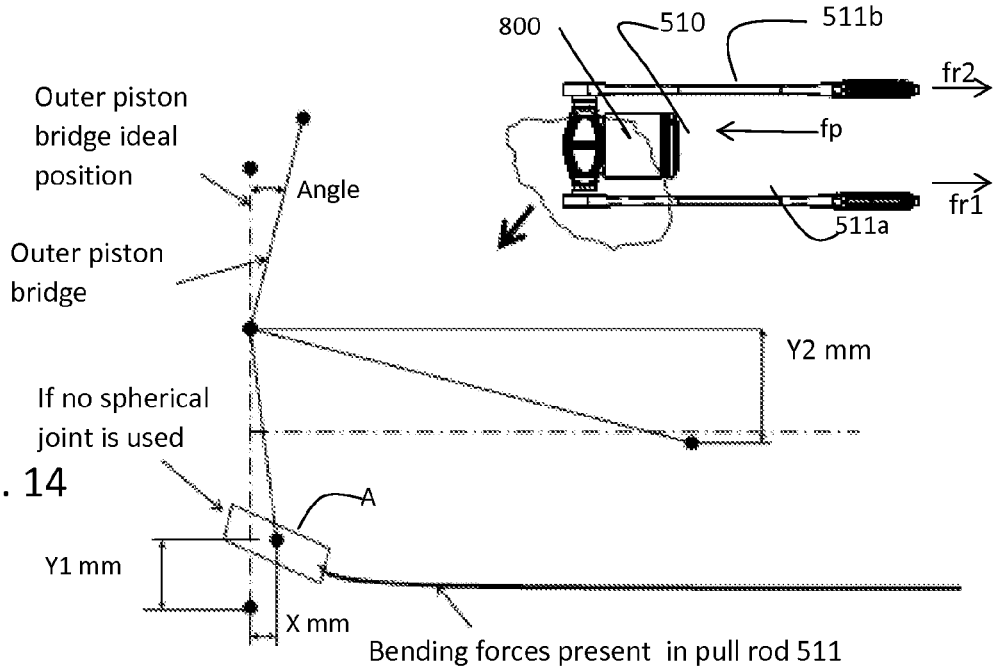
FIGS. 14 and 15 are vector graphs showing the possible effects of conflicting forces on embodiments of the present invention with and without spherical joints between the pull rods and the bridge element.
Figure 15:
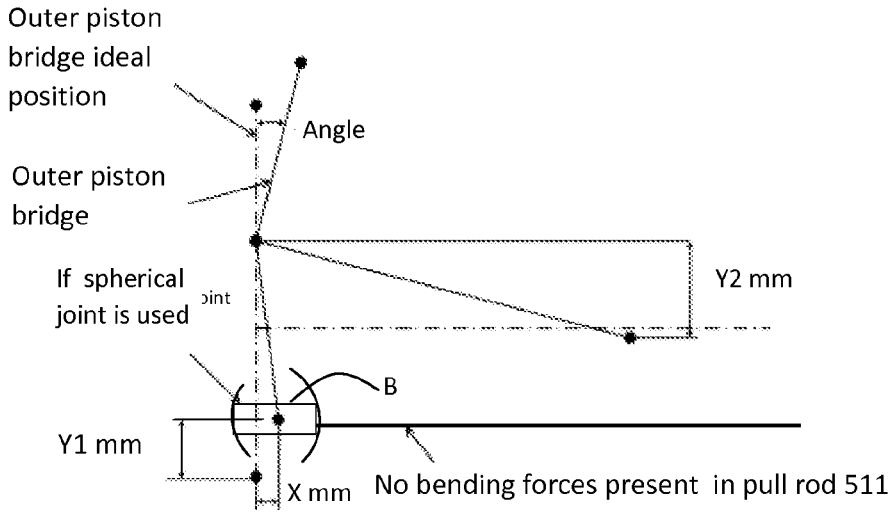

The function of the spherical bearing is illustrated with respect to the vector graphs of FIGS. 14 and 15. In FIG. 14, the condition without a spherical bearing is illustrated. In FIG. 15, the condition with a spherical bearing is illustrated. The vertical dashed line of both FIGS. 14 and 15 indicates the desired position of the guided bridge, i.e., continuously orthogonal to the cylinder axis. The angle represented in the upper portion of the vector graph illustrates an exaggerated deformation that could be exerted on the guided bridge during unusual operating load conditions.

In FIG. 14, without a spherical bearing, if such angular stress were to occur on the guided bridge and its bosses were thrown off-angle, the result would be a torque angle generated on the rod hobs at "A" that would cause slight bending and stress on the pull rods 511.

In contrast, FIG. 15 illustrates that if the guided bridge were to encounter the same stresses, the bosses would be able to rotate slightly within the rod hubs due the spherical bearing and not induce torque bending on the pull rods 511 at "B"

The embodiment shown and described herein is merely exemplary of various configurations that may be designed to exhibit the inventive concepts recited in the claims and is not intended to be restrictive.

We claim:

1. An internal combustion engine, comprising:

an engine housing (900) with a cylinder (500) defined therein, a first pair of opposed, linear sliding surfaces (804, 806), and a second pair of opposed, linear sliding surfaces (808, 810);

a piston (510) disposed in the cylinder (500) and adapted to reciprocate within the cylinder (500);

a crankshaft (700) disposed in the engine housing (900);

a first pullrod (515*a*) having a first end and a second end with the first end of the first pullrod (515*a*) coupled to the crankshaft (700);

a second pullrod (515*b*) having a first end and a second end with the first end of the second pullrod (515*b*) coupled to the crankshaft (700);

a bridge (800) having: a nose (802) that contacts a socket (315) in the piston (510) on one end of the bridge; and a base (801) on the other end of the bridge (800), the base (801) having:

a first pair of guide surfaces (904, 906) that ride on the first pair of linear sliding surfaces (804, 806) during reciprocation of the piston (510);

a second pair of guide surfaces (908, 910) that ride on the second pair of linear surfaces (808, 810) during reciprocation of the piston (510);

a first boss (803*a*) extending outwardly from a first end of the base (801) that couples with the second end of the first pullrod (515*a*); and a second boss (803*b*) extending outwardly from a second end of the base (801) that couples with the second end of the second pullrod (515*b*).

2. The engine of claim 1 wherein the first pair of linear sliding surfaces (804, 806) face toward each other and the second pair of linear sliding surfaces (808, 810) face toward each other.

3. The engine of claim 1 wherein the first pair of guide surfaces (904, 906) face away from each other and the second pair of guide surfaces (908, 910) face away from each other.

4. The engine of claim 1 wherein the engine housing includes an extension cap (902) and the first and second pairs of linear surfaces (804, 806, 808, 810) are disposed in the extension cap (902).

5. The engine of claim 4 wherein passages are provided in the extension cap (902), the passages adapted to allow lubricating oil to be directed onto the linear surfaces (804, 806, 808, 810).

6. The engine of claim 1 wherein the nose (802) comprises a convex portion of a sphere; the socket (315) comprises a concave portion of a sphere; the diameters of the concave and convex portions of spheres have diameters such the socket (315) receives the nose (802).

7. The engine of claim 1, further comprising:

a first plurality of needle bearings (514*a*) disposed between the second end of the first pullrod (515*a*) and the first boss (803*a*); and a second plurality of needle bearings (514*b*) disposed between the second end of the second pullrod (515*b*) and the second boss (803*b*).

8. The engine of claim 1 wherein the bridge (800) is generally triangularly shaped with the nose (802) at one point of the triangle, the first boss (803*a*) on a second point of the triangle, and the second boss (803*b*) on a third point of the triangle.

9. The engine of claim 1 and the first and second bosses (803*a*, 803*b*) are generally perpendicular to the cylinder (500).

10. The engine of claim 1 wherein the nose (802) defines a hole (812) that runs perpendicular to a central axis of the cylinder, the engine further comprising:

a pin (312) fastened to an underside of the piston (310) and extending through the hole (812).

11. The engine of claim 10 wherein the pin (312) is fastened to the underside of the piston (310) by bolts (314, 316) that are inserted through ends of the pin (312).

12. An opposed-piston, internal-combustion engine, comprising:

an engine housing (900) with a first cylinder (500) defined therein and a first pair of opposed, linear sliding surfaces (804, 806), and a second pair of opposed, linear sliding surfaces (808, 810) formed on the engine housing (900);

a crankshaft (700) disposed in the engine housing (900) with the crankshaft (700) located between the first cylinder (500) and the second cylinder (600)

an outer piston (510) and an inner piston (520) disposed in the cylinder (500) with the pistons (510, 520) adapted to reciprocate within the cylinder (500);

a first pullrod (515*a*) having a first end and a second end with the first end of the first pullrod (515*a*) coupled to the crankshaft (700);

a second pullrod (515*b*) having a first end and a second end with the first end of the second pullrod (515*b*) coupled to the crankshaft (700);

a first bridge (800) having: a nose (802) that contacts a socket (315) in the piston (510) on one end of the bridge; and a base (801) on the other end of the bridge (800), the base (801) having:

a first pair of guide surfaces (904, 906) that ride on the first pair of linear sliding surfaces (804, 806) during reciprocation of the piston (510);

a second pair of guide surfaces (908, 910) that ride on the second pair of linear surfaces (808, 810) during reciprocation of the piston (510);

a first boss (803*a*) extending outwardly from a first end of the base (801) that couples with the second end of the first pullrod (515*a*); and a second boss (803*b*) extending outwardly from a second end of the base (801) that couples with the second end of the second pullrod (515*b*).

13. The engine of claim 12 wherein the engine, further comprises:

a second cylinder (600) defined in the engine housing (900) wherein the first cylinder (500) is disposed opposite the second cylinder (600) with respect to the crankshaft (700) and the engine is an opposed-piston, opposed-cylinder engine.

14. The engine of claim 13 wherein the second cylinder (600) has an outer piston disposed therein and a third pair of opposed, linear sliding surfaces, and a fourth pair of opposed, linear sliding surfaces formed on the engine housing (900), the engine further comprising:

a third pullrod having a first end and a second end with the first end of the third pullrod coupled to the crankshaft (700);

a fourth pullrod having a first end and a second end with the first end of the fourth pullrod coupled to the crankshaft (700);

a second bridge having: a nose that contacts a socket in the outer piston disposed in the second cylinder on one end of the second bridge; and a base on the other end of the second bridge, the base having:

a third pair of guide surfaces that ride on the third pair of linear sliding surfaces during reciprocation of the outer piston disposed in the second cylinder;

a fourth pair of guide surfaces that ride on the fourth pair of linear surfaces during reciprocation of the outer piston disposed in the second cylinder;

a first boss extending outwardly from a first end of the base associated with the second bridge that couples with the second end of the third pullrod; and a second boss extending outwardly from a second end of the base associated with the second bridge that couples with the second end of the fourth pullrod.

15. The engine of claim 14 wherein each nose (802) defines a hole (812) that runs perpendicular to a central axis of the cylinder, the engine further comprising:

a pin (312) fastened to the undersides of each piston (310) and extending through the holes (812).

16. The engine of claim 15 wherein each pin (312) is fastened to the underside of an associated piston (310) by bolts (314, 316) that are inserted through ends of the pin (312).

17. The engine of claim 12 wherein the first pair of linear sliding surfaces (804, 806) face toward each other and the second pair of linear sliding surfaces (808, 810) face toward each other.

18. The engine of claim 12 wherein the first pair of guide surfaces (904, 906) face away from each other and the second pair of guide surfaces (908, 910) face away from each other.

19. The engine of claim 12 wherein the engine housing includes an extension cap (902) and the first and second pairs of linear surfaces (804, 806, 808, 810) are disposed in the extension cap (902).

20. The engine of claim 19 wherein passages are provided in the extension cap (902), the passages adapted to allow lubricating oil to be directed onto the linear surfaces (804, 806, 808, 810).

21. The engine of claim 12 wherein the nose (802) comprises a convex portion of a sphere; the socket (315) comprises a concave portion of a sphere; the diameters of the concave and convex portions of spheres have diameters such that the socket (315) receives the nose (802).

22. The engine of claim 12, further comprising:

a first plurality of needle bearings (514*a*) disposed between the second end of the first pullrod (515*a*) and the first boss (803*a*); and a second plurality of needle bearings (514*b*) disposed between the second end of the second pullrod (515*b*) and the second boss (803*b*).

* * * * *